United States Patent [19]

Johnson

[11] Patent Number: 4,672,707

[45] Date of Patent: Jun. 16, 1987

[54] WASHING DEVICE

[76] Inventor: Arnold W. Johnson, 420 Heller Rd., #311, Menomonie, Wis. 54751

[21] Appl. No.: 310,533

[22] Filed: Oct. 13, 1981

[51] Int. Cl.[4] ..... A47K 7/03

[52] U.S. Cl. ..... 15/222; 15/244 B

[58] Field of Search ..... 15/222, 244 B, 244 A, 15/244 R

[56] References Cited

U.S. PATENT DOCUMENTS

| | | | |
|---|---|---|---|
| 269,247 | 12/1982 | Waters . | |
| 1,345,026 | 6/1920 | Riley | 15/222 X |
| 1,699,261 | 1/1929 | Wissmar | 15/222 |
| 1,990,568 | 8/1933 | Scheidler | 15/222 |
| 2,255,497 | 9/1941 | Anderson | 15/244 C X |
| 2,485,899 | 10/1949 | McBreen | 15/222 X |
| 2,544,354 | 3/1951 | Reiter | 15/222 |
| 2,659,935 | 11/1953 | Hammon | 15/244 B X |
| 3,061,841 | 11/1962 | Johnson | 15/222 X |
| 3,130,441 | 1/1963 | Hahn | 15/222 |
| 3,406,420 | 10/1968 | Siemund | 15/121 |
| 4,196,490 | 4/1980 | Jonzon | 15/222 |

FOREIGN PATENT DOCUMENTS

| | | | |
|---|---|---|---|
| 504234 | 7/1954 | Canada | 15/222 |
| 1163541 | 4/1958 | France | 15/222 |
| 439850 | 12/1935 | United Kingdom | 15/222 |
| 1079672 | 8/1967 | United Kingdom | 15/222 |

*Primary Examiner*—Chris K. Moore

*Attorney, Agent, or Firm*—Anthony G. Eggink

[57] ABSTRACT

The device is for washing and massaging body portions of a user, and, particularly, for such difficult to reach areas as a user's back. The washing device includes a new and improved composite wash body structure having opposing handle members extending therefrom. The composite wash body structure is for the releasable absorption of washing fluids, and it includes a flexible, elongated encasement member and a compressed-in-thickness, liquid expansible sponge member juxtaposed within the encasement member. The encasement member has generally opposing exterior surfaces for washing contact with the skin of a user. The opposing handle members extend from the wash body member in generally its longitudinal direction, and they provide a user with outer gripping portions to manipulate the wash body member. Upon initial contact of the composite wash body member to washing fluid, the sponge member within the encasement member expands in thickness to form a cushioned and resilient structure. Additionally provided is a wash body member having opposing exterior surfaces of varying degrees of consistency. And, provided are flexible handle members of a trapezoidal configuration which permit the manufacture of handle member portions from rectangular materials to maximize material usage.

14 Claims, 7 Drawing Figures

WASHING DEVICE

This invention relates to a device for washing and massaging difficult to reach body portions, such as the back of a user. Particularly, this invention relates to a washing device having a new and improved, composite wash body structure having opposing handle members extending therefrom.

Washing devices according to the invention are useful to provide initially generally flat structures having wash body members which expand into cushioned, wash body members upon the subjection to washing fluids. The washing devices are especially useful for providing structures that are easily assembled and shipped in commerce. Additionally, the handle members of the devices permit individual users, and especially those with limited arm movement, to comfortably and thoroughly massage and cleanse the skin of otherwise unreachable body portions, such as the back.

Many types and styles of washing devices have heretofore been proposed, and many have been especially designed for use on the back of an individual. However, these devices have either been unduly complex, expensive and difficult to manufacture, or have failed in their respective effectiveness to allow a user to easily and efficiently wash and cleanse difficult to reach body portions. Despite the longstanding need for an effective, comfortably utilized, and easy to manufacture washing device for such difficult to reach body areas, none in so far as is known has been developed. A practical, effective, easy to manufacture washing device having a unique and compact wash body member with opposing handle portions, which can be efficiently shipped through channels of commerce, is provided by the teachings of this invention.

In summary, this invention provides a device for washing and massaging normally difficult to reach body portions of a user. The device is comprised of a wash body member for contact with the skin of a user, and opposing handle members which extend from the wash body member for grasping by the user. The wash body member or portion of the device is a composite structure for the releasable absorption or storage of washing fluids, and the handle members are generally elongated, flexible members fastened to the wash body member to permit a user of the device to grasp the outer ends thereof for the manipulation of the wash body member against the skin of difficult to reach areas, such as the back of a user.

The body portion of the device includes a generally flexible encasement member having a generally elongated configuration with opposing planar surfaces. Within the encasement member is a compressed-in-thickness, liquid-expansible, sponge-like material. The sponge material is likewise elongated in configuration and generally fills the interior volume of the generally flattened encasement member. At least one of the opposing planar surfaces of the encasement member is a flexible, fabric material for bodily contact to massage and cleanse the skin of a user. The opposing, flexible handle members of the device extend from the wash body portion in generally the elongated direction.

In use, the washing device is brought in contact with washing fluids or liquids such as water, soap emulsions, and the like. And, upon initial contact with such fluids, the liquid-absorbent encasement members permits the fluid or liquid to pass therethrough to the compressed sponge material located therein. The liquid is then absorbed by and into the cellular structure of the sponge material which causes it to swell or expand within the encasement member in generally the thickness direction. The resultant configuration of the wash body portion of the device is a cushioned and resilient structure for the releasable absorption of washing fluids, well suited for massaging and cleansing purposes, and one which generally maintains its expanded configuration subsequent to initial fluid contact.

Additionally provided by the invention is a device having a compressed cellulose sponge member which expands in thickness upon initial contact with washing fluids to generally four times its original thickness. Also provided are wash body members having fastening means which secure portions of the encasement member to the sponge member, and which restrain those portions of the sponge member from expanding to form segmented, cushion portions in the wash body members when subjected to washing fluids.

Another embodiment of the invention provides a washing device having opposing handle members of a generally trapezoidal configuration. Because the flexible materials from which the handle members are constructed are generally produced in elongated, rectangular form, the trapezoidal handle configuration permits the production of handle member portions in a cost reducing manner by minimizing the amount of waste material.

These and other benefits of this invention will become clear from the following description by reference to the drawings, wherein.

Figure 2:
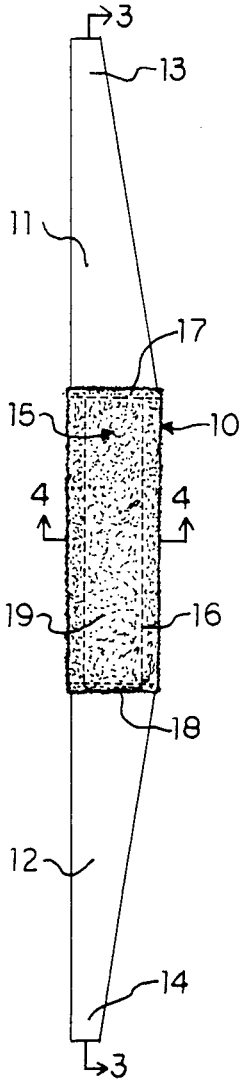
FIG. 2 is a schematic top view of the washing device of the invention.
Figure 4:
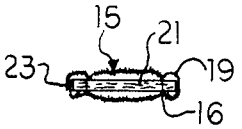
FIG. 4 is a schematic cross section of the body member of the washing device taken on lines 4—4 of FIG. 2.
Figure 4A:
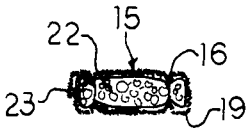
Figure 5:
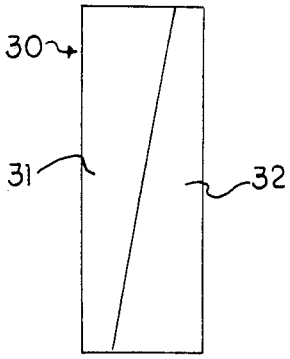

FIG. 4A is a schematic cross section of the body member of the washing device taken on lines 4—4 of FIG. 2, and which illustrates the body member of the device in its expanded form subsequent to its initial contact with washing fluids; and, FIG. 5 is a top plan view of a rectangular piece of material from which two trapezoidal component parts are cut for use in the making of handle members of a trapezoidal configuration.

Figure 1:
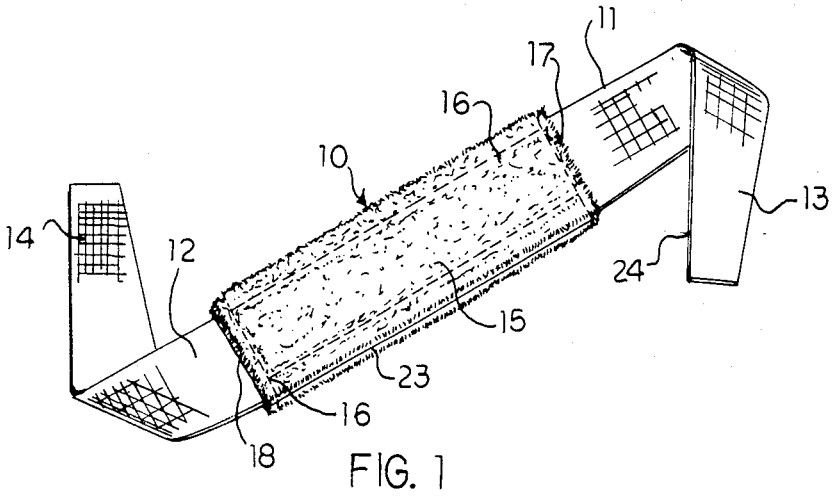
FIG. 1 is a schematic perspective view of the washing device of the invention.

Referring to FIG. 1, a washing device is illustrated having a body member or body portion 10 and opposing handle members or handle portions 11 and 12 which extend therefrom. The body member 10 is a flexible, composite structure of a generally longitudinally extending configuration, and the handle portions 11 and 12 are, likewise, flexible members which extend from the body portion 10 in the longitudinal direction thereof.

The body member 10 has an outer covering or encasement member 15 having opposing, flexibly planar outer surfaces for contact with the skin of a user of the device. The handle members 11 and 12 are attached to body member 10 by fastening means 17 and 18, respectively. The fastening means preferably consists of stitching, or the like, but can consist of a non-washing fluid soluble adhesive. The handle members 11 and 12 have, respectively, outer handle ends 13 and 14 for grasping by a user of the device, and which permit the user to manipulate the body member 10, in a reciprocating manner against the skin of such difficult to reach areas as the back. The encasement member 15 of the body member 10 is preferably constructed of a flexible, piled or looped cloth material to wash, scrub and massage the body parts of a user.

Figure 3:
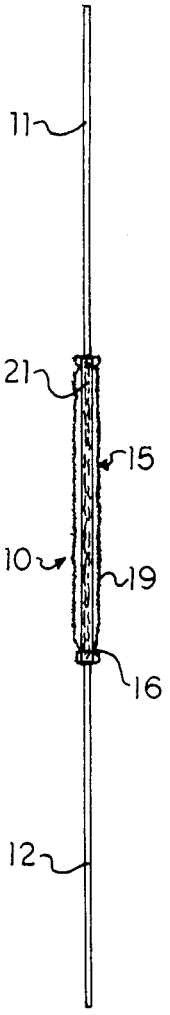
FIG. 3 is a schematic cross section of the washing device taken on lines 3—3 of FIG. 2.
Figure 3A:
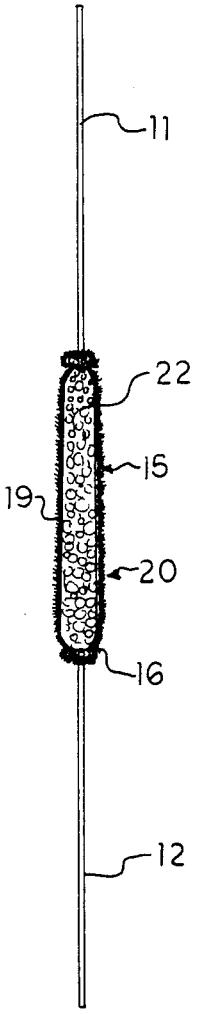
FIG. 3A is a schematic cross section of the washing device taken on lines 3—3 of FIG. 2, and which illustrates the body member of the device in its expanded form subsequent to its initial contact with washing fluids.

Referring to FIGS. 2, 3, 3A, 4 and 4A, the composite structure or nature of body member 10 is therein illustrated. Particularly, FIGS. 3 and 4 show a compressed-in-thickness, liquid-expansible sponge material member 21 within encasement member 15. The sponge member 21 is a generally flat, slab like, compressed-in-thickness, flexible, releasably liquid absorbent material having the same general configuration as the encasement member 15, so that it can be easily inserted therein. The sponge member 21 can be constructed of a synthetic, cellular plastic material or of a cellulose material which readily absorbs washing fluids, and which exhibits a compressable and elastic character subsequent to liquid absorption.

The sponge member 21 is inserted into the encasement member 15 in a generally dry, compressed-in-thickness condition. It is only upon the subsequent initial contact of washing fluids, such as water, soap emulsions, or the like, with the sponge member 21 that results in its expansion or swelling in thickness to produce a cushioned and resilient state as illustrated in FIGS. 3A and 4A. And, subsequent to the initial contact of washing fluids the body member 10 generally retains its cushioned and resilient configuration, whether wet or dry. One particular embodiment of the invention utilizes a compressed cellulose material, as sponge member 21, which expands in thickness approximately four times from its original compressed thickness when subjected to initial contact to washing fluids. In essence, the effective nature or character of the compressed sponge material 21 does not exist until it is expanded by initial absorption of washing fluids.

As illustrated in FIGS. 1 through 4, the body member 10 is comprised of a composite structure having an encasement member 15 and a sponge member 21 therein. The encasement member 15 is a flexible, generally flat envelope type structure having two generally opposing sheet like walls. The exterior surfaces of the walls are for bodily contact with the user of the washing device. The encasement member 15 can be constructed of two flexible planar wall structures which are subsequently fastened, or can be constructed of one planar structure which is folded to form an envelope type structure to receive sponge member 21. At least one of the exterior surfaces is of a piled fabric material, indicated as 19. The piled fabric face 19, is generally a piled fabric material such as terry cloth, or the like, which is commonly used for wash cloth purposes. When the encasement member 15 is constructed of one, folded planar structure, both opposing exterior surfaces would be of the same consistency. However, when utilizing two flexible, fastened, planar wall structures it is possible to construct a wash body member 10 having opposing exterior faces of varying consistency. The latter embodiment permits a user to scrub and cleanse the skin using the rougher surface, and to massage the skin using the relatively smoother surface. The respective wall structures of this embodiment consist of individual wall structures having surfaces of varying pile or loop heights, or which consist of two different fabric materials. In the latter embodiment, one wall structure could be of a piled, terry cloth material, while the second is constructed of a smooth or velour type material. Additionally, these materials can be of a natural or synthetic nature, and can be woven or non-woven. The important aspect of the encasement member material is that it is generally flexible, permits the flow of washing fluids therethrough, and has an exterior surface for washing or massaging purposes. However, when two varying material structures are utilized it is only necessary that one of the structures permits the flow therethrough of washing fluids.

The body member 10 has fastening means 16 to attach the encasement material to sponge member 21. The fastening means, which consists of stitching thread, or the like, preferably extends through the entire thickness of the body member so that upon the expansion or swelling of sponge member 21 the body member takes the form of a segmented, cushioned structure. This cushioned configuration is illustrated in FIGS. 3A and 4A, wherein the compressed-in-thickness sponge member 21 has been transformed into an expanded-in-thickness sponge member 22 due to the absorption of washing fluids. Fastening means 16 can be utilized in any longitudinal or transverse lineation across and through the body member 10 to form segmented, cushioned portions thereof. The fastening means 16 does not expand in length upon subjection to washing fluids so that only the non-fastened portions of the body member expand to form cushioned segments.

Additionally, body member 10 has fastening or stitching means 23 to form the encasement member 15. When a folded, planar, fabric structure is utilized only one peripheral side is fastened, and when two wall surfaces are utilized two such peripheral sides are fastened. Optionally, for cosmetic purposes, the fastening means or stitching appears on the interior of the encasement member structure. In either of the above configurations, a sleeve-type structure results. And, it is within this sleeve-type encasement structure that the compressed-in-thickness sponge member 21 is placed. The opposing handle members 11 and 12 are then fastened to the open ends of the sleeve by means of fastening or stitching means 17 and 18.

The handle members 11 and 12 for attachment to body member 10 are preferably elongated, flexible structures having outer end portions 13 and 14, respectively, for grasping by a user. The handle members are constructed of a cloth-type material, either woven or non-woven. Unlike the material for the encasement member, however, this material need not be absorbent in nature. The handle members can consist of a single thickness or of a fastened together double thickness. Because flexible cloth materials are normally supplied in an elongated rectangular manner, FIG. 5 illustrates a cutting configuration which permits handle member portions to be cut from such supplied structures in an economical, waste reducing method.

As illustrated in FIG. 5, from a rectangular structure 30 a diagonal cutting line produces two trapezoidal handle member portion segments 31 and 32. It has been found that an internally stitched, double thickness handle member presents the preferred configuration. This configuration would require handle member portion segments from two rectangular structures having cutting lines in opposite diagonal directions so that the exterior faces of the cloth face outward when the trapezoidal segments are fastened in alignmemt.

Although the washing device of the invention thus far described utilizes an encasement member 15 and opposing handle members 11 and 12, all made of flexible, cloth type materials, it would be possible to construct the washing device of all one material. Although this structure would not be preferred because the respective materials represent specific functions, in that the encasement member should be a more absorbent material than that for the handle members, this structure does present an alternative embodiment for the washing device.

The trapezoidal handle member configuration illustrated in the drawings present the preferred embodiment for the washing device. And, a double thickness structure handle member having internal stitching or fastening means 24, as shown in FIG. 1, presents the preferred handle member construction.

The specific dimensions of the washing device can, of course, vary to meet the requirements of an individual user. The main requirement being that the outer ends 13 and 14 of the handle members be easily grasped or gripped by a user to permit the manipulation and maneuvering of the body member of the device against the skin of the back in a reciprocating motion, to thereby scrub, massage and cleanse the back of the user. One such device having an overall length of approximately 52 inches, a body member with a length of approximately 15 inches and width of approximately $3\frac{1}{2}$ inches, has been found well suited for most users. The flexibility of the handle members permits a user seeking a shorter overall length to wrap a portion of the handle members about the hand to shorten the overall effective length and, thereby, obtain a specific desired length. And, because the handle members of this washing device has no specific place or hook for a user to grasp, one size permits use by most users.

In use, the washing device of the invention provides an apparatus for washing and massaging such difficult to reach areas as the back of a user. And, the device provides a unique, composite body member structure for the releasable absorption of washing fluids, and one which has a uniquely designed, cost effective pair of handle members which allows use by a wide range of users. Additionally, the initially flat configuration of the body member permits the device to be easily packaged and shipped through commerce before it is expanded by a user into a resilient and cushioned configuration upon initial contact with washing fluids.

As many changes are possible to the embodiments of this invention, utilizing the teachings of the invention, the description above and the accompanying drawings should be interpreted in the illustrative and not in the limited sense.

That which is claimed is:

1. A washing device for cleansing and massaging a body of a user, said device comprising an initially expansible wash body member for the releasable absorption of washing fluids and a pair of opposing handle members extending from said wash body member for the manipulation of said wash body member by a user of said device, said wash body member being a flexible, composite structure having a flexible, elongated, opposing wall structured encasement member with an interior surface area and essentially having a unitary, initially compressed-in-thickness, liquid-expansible sponge member juxtaposed within said encasement member, said sponge member being a compressed-in-thickness cellulose material which expands in thickness upon the initial contact to washing fluids to approximately four times its original, compressed thickness, said opposing wall structures of said encasement member having exterior surfaces for contact with a body of a user, said opposing handle members of said device being flexible, elongated structures being fastened to and extending from said wash body member in generally the elongated direction thereof, each said handle member having outer end portions for grasping by a user of said device, whereby, upon initial contact of said wash body member to washing fluids said initially compressed sponge member thereof expands in thickness within said encasement member, and by expanding against the interior surface area of said encasement member, to form a cushioned wash body for washing and massaging a body of a user of said device.

2. The washing device of claim 1 wherein said elongated handle members are of a trapezoidal configuration having their non-parallel sides extending in the elongated direction from said wash body member of said device, whereby trapezoidal handle member portions cut from rectangular, flexible handle member materials reduces the amount of waste material incurred.

3. The washing device of claim 1, wherein said wash body member additionally has fastening means extending therethrough to attach said encasement member to said unitary, initially compressed-in-thickness sponge member, and to fix opposing portions of said encasement member wall structures approximately at a distance of the thickness of said sponge member in its initial compressed state, whereby upon the initial contact of said wash body member to washing fluids said sponge member expands in thickness to form a segmented, cushioned wash body defined by said fastening means.

4. The washing device of claim 3 wherein said fastening means consists of a stitching thread material.

5. The washing device of claim 4 wherein said elongated handle members are of a trapezoidal configuration having their respective non-parallel sides extending in the elongated direction from said wash body member.

6. The washing device of claim 1 wherein said exterior surfaces of said opposed wall structured encasement member have at least one said exterior surface being a piled, fabric material.

7. The washing device of claim 1 wherein said exterior surfaces of said opposed wall structured encasement member have varying textures, whereby said rougher textured exterior surface is for scrubbing a body of a user and, whereby said smoother textured exterior surface is for massaging a body of a user.

8. The washing device of claim 1 wherein said flexible opposing handle members and said flexible encasement member are constructed of the same flexible material, and wherein said handle members are contiguous with said encasement member, said device further having fastening means about the periphery thereof, and further having said fastening means at the respective intersections of said opposing handle members and said encasement member to secure said sponge material within said encasement member.

9. The washing device of claim 8 wherein said flexible material consists of a piled, fabric material.

10. A washing device for cleansing and massaging a body of a user, said device comprising an initially expansible wash body member for the releasable absorption of washing fluids and a pair of opposing handle members extending from said wash body member for the manipulation of said wash body member by a user of said device, said wash body member being a flexible, composite structure having a flexible, elongated, opposing wall structured encasement member with an interior surface area and essentially having a unitary, initially compressed-in-thickness, liquid-expansible sponge member juxtaposed within said encasement member, said sponge member further being substantially expansible in thickness relative to its intially compressed thickness when subjected to fluids, said opposing wall structures of said encasement member having exterior surfaces for contact with a body of a user, said wash body member additionally having fastening means extending therethrough to attach said encasement member to said unitary, initally compressed-in-thickness sponge member, and to fix opposing portions of said encasement member wall structures at a distance approximately the thickness of said sponge member in its initially compressed state, said opposing handle members of said device being flexible, elongated structures being fastened to and extending from said wash body member in generally the elongated direction thereof, each said handle member having outer end portions for grasping by a user of said device, whereby, upon initial contact of said wash body member to washing fluids said initially compressed sponge member expands in thickness against the interior surface area of said encasement member having portions thereof fixed by said fastening means, to form a segmented and cushioned wash body defined by said fastening means for washing and massaging a body of a user of said device.

11. The washing device of claim 10, wherein said opposing wall structures of said encasement member have one said structure being permeable for the transfer therethrough of washing fluids.

12. The washing device of claim 11, wherein said fluid permeable wall structure is of a terry cloth material.

13. The washing device of claim 10, wherein said exterior surfaces of said opposing wall structured encasement member have varying textures for providing a choice of washing and massaging surfaces to a user of said device.

14. The washing device of claim 12, wherein said sponge member is of an initially compressed-in-thickness cellulose material which expands in thickness upon its initial contact with washing fluids to approximately four times its original, compressed thickness.

* * * * *